US007098593B2

(12) United States Patent
Teng

(10) Patent No.: US 7,098,593 B2
(45) Date of Patent: Aug. 29, 2006

(54) STATIONARY ION COLD CATHODE FLUORESCENT LIGHTING SYSTEM

(76) Inventor: Ming-Ching Teng, 2F., No. 18, Lane 333, Sec. 3, Roosevelt Rd., Jhongjheng District, Taipei City (TW)

( * ) Notice: Subject to any disclaimer, the term of this patent is extended or adjusted under 35 U.S.C. 154(b) by 7 days.

(21) Appl. No.: 10/923,723

(22) Filed: Aug. 24, 2004

(65) Prior Publication Data

US 2006/0043913 A1 Mar. 2, 2006

(51) Int. Cl.
*H01J 17/00* (2006.01)
*H01J 21/10* (2006.01)

(52) U.S. Cl. ..... 313/581; 313/492; 313/306

(58) Field of Classification Search ..... 315/56, 315/326, 334; 313/485, 491, 492, 581, 306; 362/84, 260

See application file for complete search history.

(56) References Cited

U.S. PATENT DOCUMENTS 6,135,620 A * 10/2000 Marsh ..... 362/377
2003/0151350 A1* 8/2003 Xu ..... 313/485
2005/0184667 A1* 8/2005 Sturman et al. ..... 315/59

* cited by examiner

*Primary Examiner*—Thuy Vinh Tran
(74) *Attorney, Agent, or Firm*—Bacon & Thomas PLLC

(57) ABSTRACT

The present invention relates to a stationary ion cold cathode fluorescent lighting system comprising a cold cathode fluorescent lamp with a radial D. C. electric field established therein so as to sufficiently energize electrons ionized therein through a process of chain collision and reduce the radial velocity of mercury ions ($Hg^{+2}$) and argon ions ($Ar^{+2}$) ionized therein to a virtual zero when touching a phosphor layer on the inside surface of the lamp, preventing the phosphors from being bombarded by the ions and forming an amorphous layer thereon, and preventing mercury from embedding in the phosphor layer, and with an axial anti-equivalent D. C. electric field established between electrodes of the lamp so as to prevent mercury from accumulating on the electrodes and to maximize the life of the phosphor layer as well as the lamp.

6 Claims, 3 Drawing Sheets

*- Prior Art -*

*- Prior Art -*

*- Prior Art -*

STATIONARY ION COLD CATHODE FLUORESCENT LIGHTING SYSTEM

BACKGROUND OF THE INVENTION

1. Field of the Invention

This invention relates to a cold cathode fluorescent lighting system, more particularly to a stationary ion cold cathode fluorescent lighting system comprising a cold cathode fluorescent lamp with a radial D. C. electric field established therein to reduce the radial velocity of the ions therein to a virtual zero when touching the phosphors evenly coated on the inside surface of said lamp, and with an axial anti-equivalent D. C. electric field established between the two electrodes of said lamp so as to prevent a mercury accumulation on the cathodes and to lengthen life of said lamp.

2. Prior Art of the Invention

Referring to FIG. 1, the glass lamp 10 of a conventional fluorescent lighting system is mainly used for forming a closed space filled mainly with some inert gas e.g., argon (Ar) at a pressure about 0.3% atmosphere pressure and mercury (Hg); a layer 11 of phosphor layer e.g., zinc silicate ($Zn_2SiO_4$) on the inside surface of the lamp is used for illuminating purpose; both the two ends of the lamp are provided with tungsten filaments 121, 122 (also used for cathodes); one end of each of the filaments 121, 122 is electrically connected through an insulating end plug 123 to a starter 13; the other end thereof is electrically connected through the insulating end plug 123 to an A. C. power source 16 via a ballast 14 and a switch 15, respectively. Referring to FIG. 2, said starter 13 mainly comprises a parallel capacitor C and a neon lamp 130 provided therein with two electrodes 131, 132 which are unconnected electrically when the system is not operating, wherein the bimetal electrode 132 tends to bending toward making an electrical contact with the electrode 131 under thermal influence; the ballast 14 is an inductor comprising a solenoid with a soft magnetic core for coordinating with the A. C. electric power source 16 and the ballast 14 to control the current $I_{13}$ of the starter and the current of the lamp 10 and safeguard the starter 13 and the lamp 10.

Referring again to FIG. 1 and FIG. 2, the operating sequence of said lighting system is as follows:

1. After the switch 15 is turned on, the bimetal electrode 132 bends and makes an electrical contact with the electrode 131 under the thermal influence of the neon discharge between said two electrodes, forcing a current $I_{13}$ through and heating up said filaments 121, 122 so as to release massive thermionic electrons while the lamp 10 is still not conducting.

2. Once an electrical contact is made between the electrodes 131, 132 of the bimetal switch, the bimetal electrode 132 cools off and breaks away from the electrode 131, interrupting the current $I_{13}$ in the starter 13, the filaments 121, 122 and the ballast 14.

3. At the interruption of the current $I_{13}$, the ballast (inductor 14) induces a voltage of 1500 volts, wherein approximately 600 volts thereof is applied briefly between the two points a and b as shown in FIG. 1 which is too low to trigger the neon lamp 13 but is high enough to energize the thermionic electrons into an argon discharge with massive argon ions ($Ar^{+2}$) and argon electrons $e_a^-$ (a symbol for differentiating from the mercury counterpart) produced; said argon electrons $e_a^-$ are energetic enough to force the mercury into a process of chain discharge with massive mercury ions ($Hg^{+2}$) and mercury electrons ($e_h^-$) produced. Through the process of splitting and recombination, these particles form a plasma in the lamp 10 in equilibrium state with the mercury electrons ($e_h^-$) carrying an ultraviolet (UL) light of 2537 Å (10 exp–10 m) useful for phosphorescing purpose, while the argon electrons $e_a^-$ carrying their characteristic UV light for ionizing the mercury.

When the said particles touch the phosphor layer 11 on the inside surface of the lamp 10, they affect the phosphors differently. The argon electrons $e_a^-$ do not cause the phosphors to illuminate; the mercury electrons $e_h^-$ force the phosphors to illuminate visible light (380 Å~780 Å) according to Stokes Law and the following photoelectric quantum formula:

$$\Delta W = \frac{hc}{\lambda}, \tag{1}$$

wherein ΔW refers to the released energy, h refers to Planck constant (6.62517 exp (−34) j×sec), c refers to the light speed (3 exp 8 meter per second), λ refers to the wavelength of the phosphoresced light. Again referring to FIG. 1, since the production of the light by this system is initiated by the thermionic electrons from the hot cathodes in its lamp, this conventional lighting system is called "hot cathode fluorescent lighting system", which is abbreviated as "HCFL".

It is known that the phosphor layer 11 in the coating is of a crystal structure with the atoms fixed in the lattice, and is capable of phosphorescing visible light when suitably excited by some radiation (e.g., the said UV radiation of 2537 Å) as long as the crystal structure remains undisturbed. However, when the phosphor layer 11 is bombarded by the high energy mercury and argon ions, the atoms in the lattice can be dislodged easily, resulting in forming a non-luminescent, discharge absorbing amorphous layer on the phosphor layer 11 according to the following formula:

$$S = C\sqrt{tI}, \tag{2}$$

wherein I refers to the bombarding current in the lamp, t refers to the duration of time when the current is on, C refers to a constant describing the stability of the phosphor against damage by bombardment, S refers to the thickness of the amorphous layer.

The luminosity of the phosphor layer decreases with the thickness of the amorphous layer. The mercury embeds in the phosphor layer in an irreversible process. Therefore, the forming of an amorphous layer and the embedding of the mercury decrease the luminosity of the phosphor layer 11 according to the following formula:

$$\frac{B_t}{B_0} = \exp\left(-a\,C\cdot\sqrt{tI}\right), \tag{3}$$

wherein $B_t$ refers to the luminosity at time t, $B_0$ refers to the initial luminosity, a refers to the light absorbing constant of the amorphous layer. Because a and C are constants, and I is roughly constant in operation, they can be combined for obtaining the Lehmann formula below:

$$\frac{B_t}{B_0} = \exp\left(-\sqrt{t/\upsilon}\right) \quad \upsilon = 1/(C^2a^2I), \tag{4}$$

which has been confirmed by Willi Lehmann in his report in J. Electrochem. Soc., 426 (February, 1983) and by Osamu Tada's report in J. Electrochem. Soc., 1366 vol. 131 No. 6 (June, 1984). Therefore, it can be determined that, the luminosity of the fluorescent lamp 10 decreases with time by the amorphous layer formed on the phosphor layer and the mercury embedding in the phosphor layer.

Regarding the liquid crystal display (LCD), especially for the portable type LCD, where the cold cathodes fluorescent lamp (abbreviated as "CCFL") is used for backlighting the liquid crystal display, as shown in FIG. 3, which has the following differences in comparison with the structure of the "hot cathode fluorescent lighting system" shown in FIG. 1:

1. Without filaments in the lamp,
2. Without neon starter,
3. Without ballast, and
4. A self-contained high frequency A. C. power source 26 for the CCFL.

In the case of a lighting system with a lamp of 3 mm×160 mm, as shown in FIG. 3, it requires to apply a voltage of 1600 volts at 55 kHz in frequency from A. C. power source 26 to its two cathodes 221, 222 for turning on the light.

For both the HCFL and the CCFL lighting systems, the ideal power source is to be with a waveform of zero crest factor. The system as shown in FIG. 1 can easily meet this requirement, as it is powered from an ideal mains of A. C. sine wave power source of the frequency 60 Hz. But due to the component spread, and the other reasons the Royer converter together with the lamp inside the system as shown in FIG. 3, provides the system with an asymmetric power waveform of the frequency 55 KHz, unable to meet the requirement of having a crest factor equal to zero. Such a power produces an axial equivalent D. C. electric field in the plasma in the lamp. When the electrode 221 is at a potential relatively higher than the electrode 222, the axial equivalent D. C. electric field forces a steady ion migration of, and a mercury accumulation on the electrode 222. This phenomena means that the mercury component forcing the phosphors to illuminate visible light is decreasing, resulting in luminosity reduction for the lamp 20. Therefore, said mercury accumulation on the cathode, the mercury embedment in the phosphor layer and the formation of an amorphous layer on the phosphor layer by ion bombardment are the three major determinant factors for the life of the lamp which has a minimum requirement of 20,000 hours at 50% luminosity for such application.

Furthermore, the electromagnetic radiation from the A. C. power source interferes with the neighboring electrical equipments; causing a myopia and hazard for the long term user. To limit the field intensity of such a radiation, a Swedish specification TCO91 has been established as follows:

| | TCO91 |
|---|---|
| Electrostatic Potential | <±500 volts |
| Magnetic Field | |
| Frequency Band I 5 Hz~2 kHz | ≦200 $nT_{rms}$, measured from 30 cm in front of the display and 50 cm around the display |
| Frequency Band II 2 kHz~400 kHz | ≦25 $nT_{rms}$, measured from 50 cm around the display |
| Alternating Electric Field | |
| Frequency Band I 5 Hz~2 kHz | ≦10 $V/m_{rms}$, measured from 30 cm in front of the display |

-continued

| | TCO91 |
|---|---|
| Frequency Band II 2 kHz~400 kHz | ≦1.0 $V/m_{rms}$, measured from 30 cm in front of the display and 50 cm around the display |

The present invention is prompted by the intention to solve said problems in said conventional fluorescent lighting systems, yet with low cost solutions.

SUMMARY OF THE INVENTION

One objective of this invention is to provide stationary ions cold cathode fluorescent lighting system with a radial D. C. electric field established in the cold cathode fluorescent lamp thereof so as to enhance the plasma forming capability of the electrons produced therein; and to cause the velocity of the ions in said radial D. C. electric field to reduce to a virtual zero when touching the phosphor in the phosphor layer on the inside surface of said lamp, keeping said ions radially fixed in the plasma, thereby avoiding the formation of an amorphous layer on the phosphor layer by the ion bombardment on said phosphor; and preventing the mercury from embedding in said phosphor layer, so that the lamp life is maximized; and the electrons therein further energized.

The other objective of this invention is to provide said stationary ion cold cathode fluorescent lamp lighting system with a D. C. electric power source, so that an axial anti-equivalent D. C. electric field is established between the electrodes in the lamp thereof to prevent the mercury from steadily migrating toward and accumulating on the cathode at a potential relatively lower than the other cathode of said lamp. Hence, the lamp life is maximized without reduction in mercury supply for the plasma in said lamp.

The above and other objects, features and advantages of the present invention will become apparent from the following detailed description taken with the accompanying drawings.

DETAILED DESCRIPTION OF THE PREFERRED EMBODIMENTS

Figure 1:
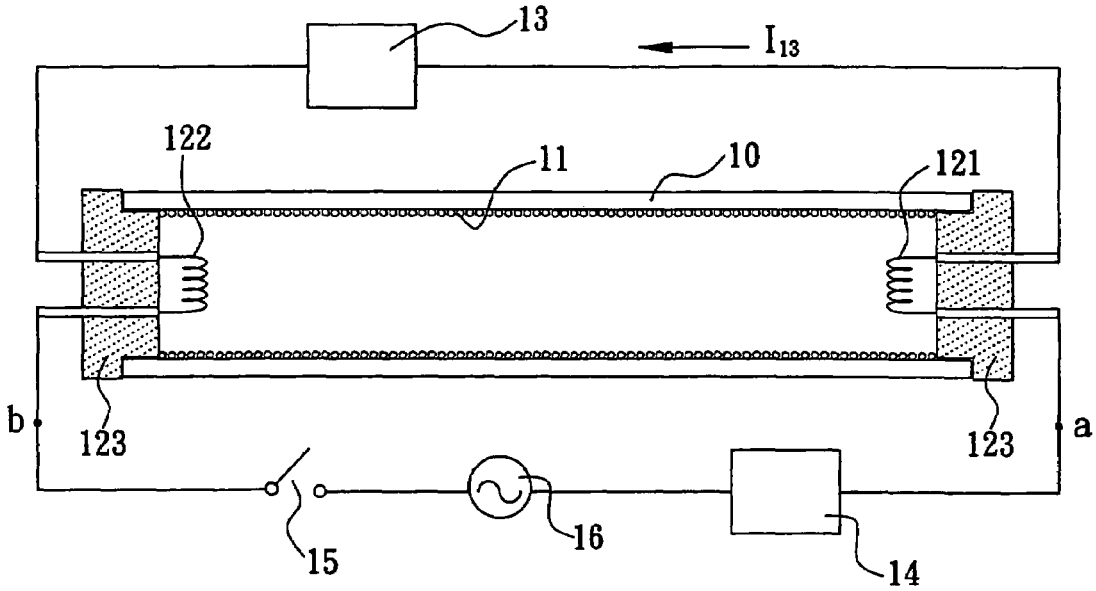
FIG. 1 is a schematic view of a conventional hot cathode fluorescent lighting system.
Figure 2:
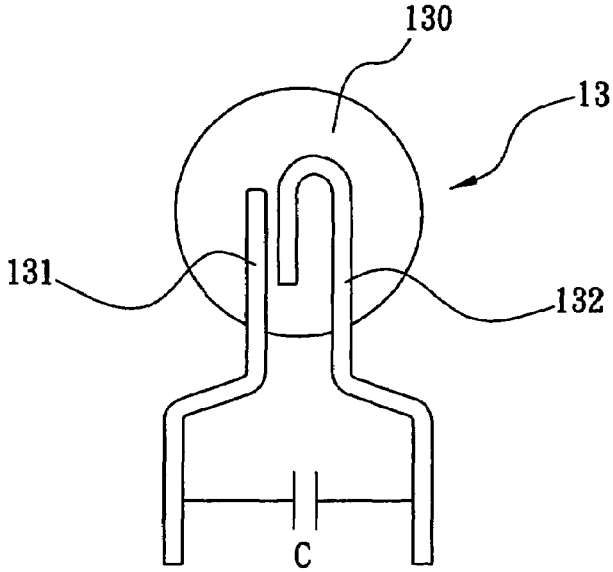
FIG. 2 is a schematic view of a neon starter for the conventional hot cathode fluorescent lighting system.
Figure 3:
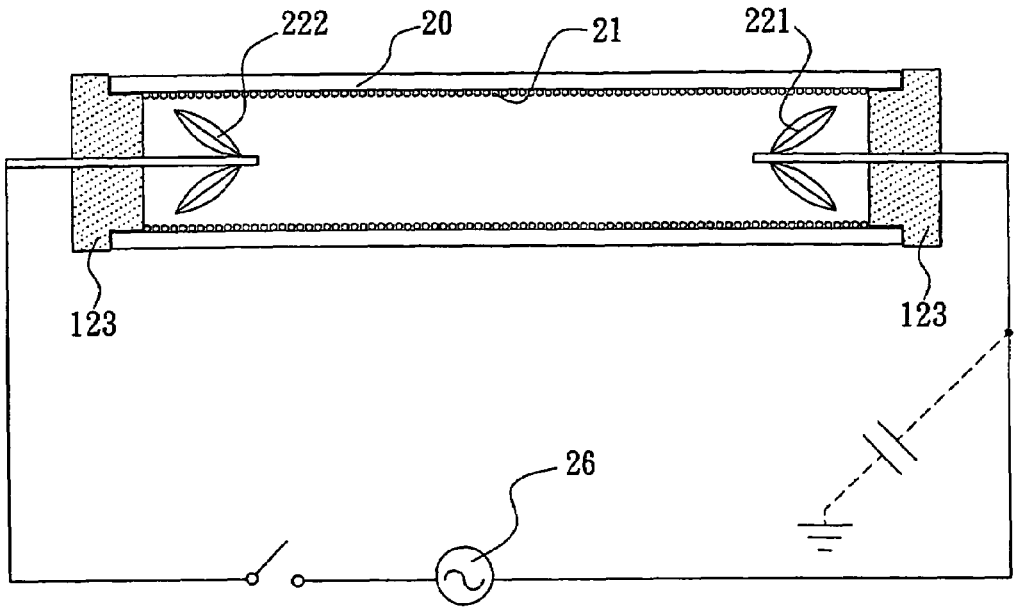
FIG. 3 is a schematic view of a conventional cold cathode fluorescent lighting system.
Figure 4:
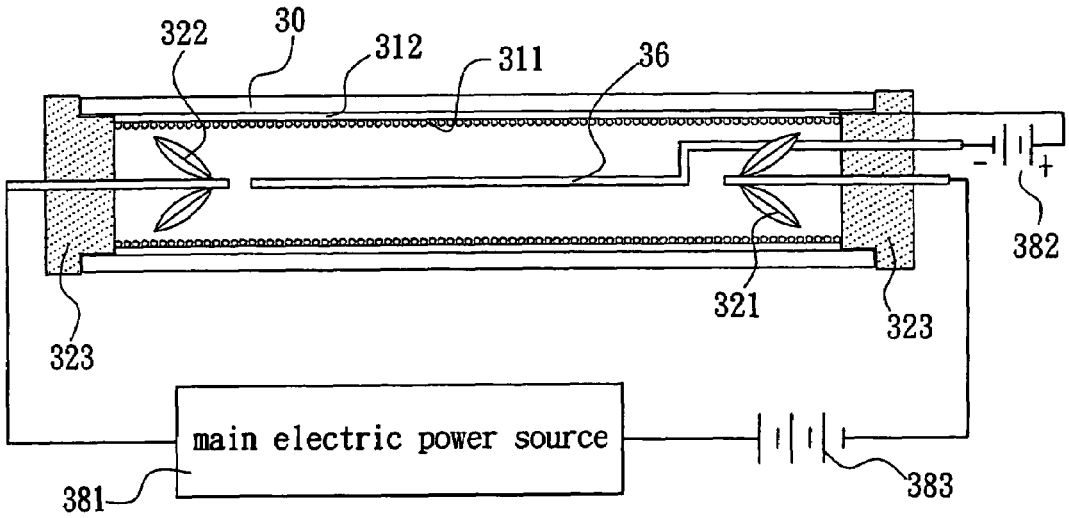
FIG. 4 is a schematic view of an embodiment of the stationary ion cold cathode fluorescent lighting system according to the present invention.

A preferred embodiment of a stationary ion cold fluorescent lighting system according to the present invention is depicted in FIG. 4, which comprises a lamp 30, a main electric power source 381 (A. C.,) a radial electric field D. C. power source 382 and an axial anti-equivalent D. C. electric field power source 383 (presumably, an electrode 321 is at a potential higher than another electrode 322), wherein a light transmissive electrically conductive layer (e.g., indium tin oxide ITO, or antimony tin oxide ATO) 312 is coated on the inside surface of said lamp 30, and a phosphor layer 311 is then coated on the electrically conductive layer 312, enabling the electrically conductive layer 312 to be at the position right between the inside surface of said lamp 30 and the phosphor layer 311. The electrically conductive layer 312 is then connected to a positive terminal of the radial electric field D. C. power source 382 through an insulating end plug 323. Said lamp 30 further comprises a center electrode 36 axially provided therein with one end connected to a negative terminal of the radial D. C. electric field power source 382 through an insulating end plug 323. Said main electric power source 381 is connected to the electrodes 321 and 322 of said lamp 30 via the axial anti-equivalent D. C. electric field power source 383 (D. C.) to generate an axial A. C. electric field, which accelerates the electrons in said lamp 30 and then activates the argon electrons and mercury electrons to generate a process of chain discharge and form a plasma in said lamp 30, enabling therewith the phosphor layer 311 coated on the inside surface of said lamp 30 to produce visible light and achieve the purpose of lighting. After the plasma is established within the lamp 30, said main electric power source 381 at an original voltage of approximately 1600 vac is reduced to a discharge maintaining voltage of about 400 vac for the normal lighting purpose.

In the preferred embodiment of the present invention, the axial anti-equivalent D. C. electric field in said lamp 30 is established so as to offset the axial equivalent D. C. electric field as produced in said lamp 30 by the main electric power source 381 when the system is in an A. C. operating mode, preventing the mercury from migrating toward and accumulating on the electrode 322 which is otherwise at a potential relatively lower than the electrode 321, ensuring an intact mercury supply for the plasma, and maximizing the life of said lamp 30.

Furthermore, the mostly mechanically energized mercury and the argon ions dislodge the phosphor layer into a non-luminescent, discharge absorbent amorphous layer when touching and bombarding said phosphor layer 311 and cause the mercury to embedding in the phosphor layer 331, isolating said phosphor from the discharge needed for phosphorescing, resulting in luminosity reduction with time for said phosphor. Therefore, in said embodiment of the present invention, a radial D. C. electric field is established between said center electrode 36 and said conductive layer 312 by the electric field power source 382 so as to cause the radial velocity of the mercury and the argon ions to reduce to a virtual zero when touching said phosphor layer 311, preventing said phosphor layer 311, preventing said phosphor layer 311 from being bombarded by the ions and forming an amorphous layer thereon, preventing the mercury from being embedded in the phosphor layer, and maximizing the life of said lamp 30.

Figure 5:
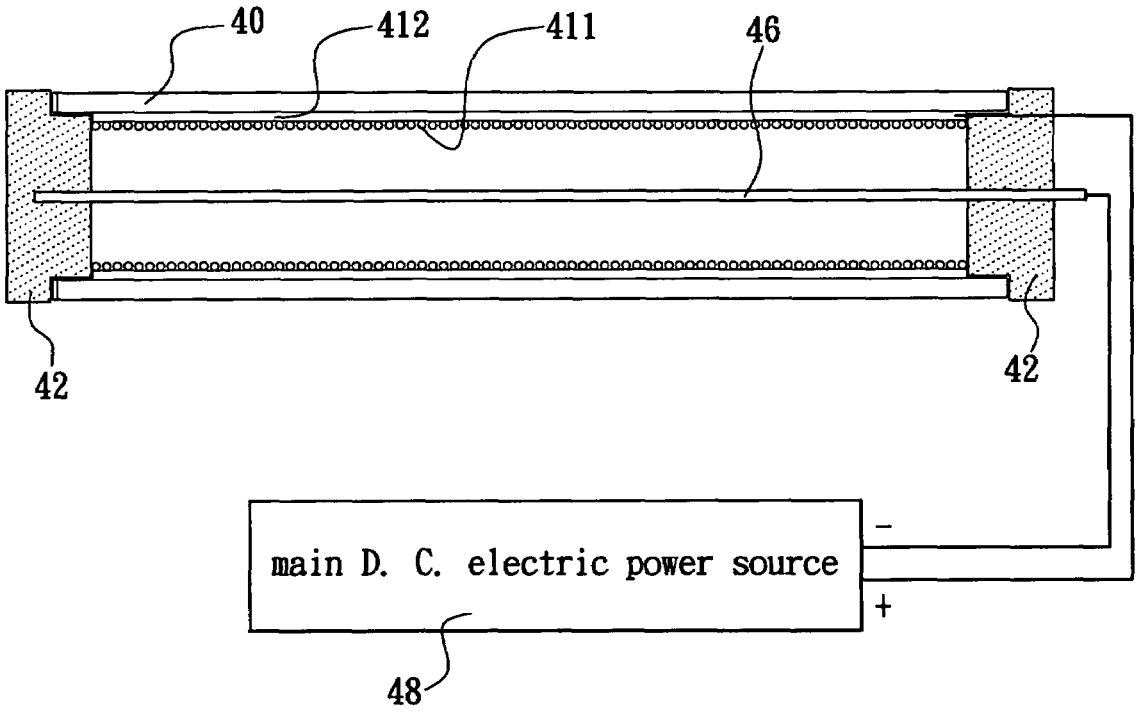
FIG. 5 is a schematic view of another embodiment according to the present invention.

In another preferred embodiment of the present invention as shown in FIG. 5, the construction thereof is simplified from FIG. 4 by eliminating the key elements, such as the radial D. C. electric field power source 382 and said axial anti-equivalent D. C. electric field power source 383. Said lighting system as shown in FIG. 5 comprises a main D. C. electric power source 48 and a lamp 40, wherein a light transmissive electrically conductive layer 412 is coated between the inside surface of said lamp 40 and a phosphor layer 411 and connected to a positive terminal of an outside main D. C. power source 48 through an insulating end plug 42; an axially provided center electrode 46 is connected to a negative terminal of the main D. C. electric power source 48 through the insulating end plug 42. When the main D. C. electric power 48 is applied to the center electrode 46 and said light transmissive electrically conductive layer 412, a radial D. C. electric field is formed therebetween to accelerate the electrons in said lamp 40 and activate the argon electrons and mercury electrons to generate a process of chain discharge and form a plasma in said lamp 40, enabling the phosphor layer 411 coated on the inside surface of said lamp 40 to produce visible light and achieve the purpose o lighting. After the plasma is established within the lamp 40, said main D. C. electric power 48 at an original voltage of approximately 1600 volts is reduced to a discharge maintaining voltage of about 400 volts for the normal lighting purpose.

In another preferred embodiment as depicted in FIG. 5, the present invention utilizes the skills of activating the argon electrons and mercury electrons to generate a process of chain discharge and form a plasma in said lamp 40 by incorporating with the conditions having a suitably dimensioned lamp 40, a suitably selected fill at a suitable pressure in said lamp 40, a combined resistance gradient of the conductive layer 412 and the center electrode 46 along the lamp axis suitably coordinated to the current density gradient in the lamp for an even radial voltage gradient along the center electrode, so that the velocity of the mercury and the argon ions is caused to reduce to a virtual zero when touching said phosphor layer 411 in said lamp 40, so as to prevent said phosphor layer 411 from being bombarded by the ions and forming an amorphous layer thereon, preventing the mercury from being embedded in said phosphor layer 411, maximizing the life of said phosphor layer 411 and improving the lightening degree of said lamp 40 due to the extra energy provided to the electrons by the main D. C. electric power source 48.

Furthermore, as a main D. C. electric power 48 is employed to power said system as shown in FIG. 5, the long term user is left without suffering from the physical hazard in the absence of the electromagnetic interference from the system or myopia from the flickering light as may otherwise be incurred by an A. C. lighting system. The neighboring electrical equipment is left without electromagnetic interference thereby. An almost equivalent lighting quality can be produced by a minor change in the main D. C. power source 48 into providing a waveform comprising a small section of a D. C. voltage producing plasma and a continuing section of the plasma maintenance D. C. voltage.

While the invention has been described by means of specific embodiments, numerous modifications and variations could be made thereto by those skilled in the art without departing from the scope and spirit of the invention set forth in the claims.

What is claimed is:

1. A stationary ion cold cathode fluorescent lighting system comprising a cold cathode fluorescent lamp with a radial D. C. electric field established therein so as to reduce a radial velocity of ions in a plasma within said lamp to a virtual zero when touching a phosphor layer on an inside surface of said lamp when in operation.

2. A stationary ion cold cathode fluorescent lighting system according to claim 1, further comprising:

a light transmissive electrically conductive layer between the phosphor layer and the inside surface of said lamp;

a center electrode along an axis of said lamp;

a main power source outside said lamp with its positive terminal connected to said conductive layer, and its negative terminal connected to said center electrode so as to establish said radial D. C. electric field which reduces the velocity of the ions therein to a virtual zero when touching the phosphor on the inside surface of said lamp when in operation.

3. A stationary ion cold cathode fluorescent lighting system according to claim 1, wherein an axial anti-equivalent D. C. electric field is established in the lamp.

4. A stationary ion cold cathode fluorescent lighting system according to claim 3, further comprising:

an electrode at each end of said lamp;

a main electric power source providing with A. C. electric power;

an axial anti-equivalent electric field power source connected to the main electric power source through the two electrodes so as to establish said axial anti-equivalent D. C. electric field between the two electrodes to offset the axial equivalent D. C. electric field as established by the main electric power source.

5. A stationary ion cold cathode fluorescent lighting system according to claim 4, wherein said axial-equivalent electric field power source is a D. C. power source.

6. A stationary ion cold cathode fluorescent lighting system according to claim 5, further comprising:

a light transmissive electrically conductive layer between the phosphor layer and the inside surface of the lamp thereof;

a center electrode extending along the axis of the lamp thereof;

a radial D. C. electric field power source outside the lamp with its positive terminal connected to said conductive layer and its negative terminal connected to the center electrode so as to establish said radial D. C. electric field between said layer and the center electrode, which reduces the velocity of the ions to the virtual zero when touching the phosphor layer on the inside surface of the lamp thereof.

* * * * *